United States Patent [19]

Scherer

[11] Patent Number: 4,745,936

[45] Date of Patent: May 24, 1988

[54] TENT

[75] Inventor: Michael J. Scherer, Berkeley, Calif.

[73] Assignee: American Recreation Products, Inc., New Haven, Mo.

[21] Appl. No.: 32,536

[22] Filed: Apr. 1, 1987

[51] Int. Cl.[4] ..... E04H 15/40

[52] U.S. Cl. ..... 135/104; 135/105

[58] Field of Search ..... 135/102, 103, 104, 115, 135/DIG. 1, 105

[56] References Cited

U.S. PATENT DOCUMENTS

| | | | |
|---|---|---|---|
| 3,223,098 | 12/1965 | Dole | 135/105 |
| 3,394,720 | 7/1968 | Moss | 135/104 |
| 3,473,272 | 10/1969 | Hasselquist | 52/63 |
| 4,195,651 | 4/1980 | Watts | 135/105 |

*Primary Examiner*—Henry E. Raduazo

*Attorney, Agent, or Firm*—Senniger, Powers, Leavitt and Roedel

[57] ABSTRACT

A tent having a plurality of sleeve(s) each of which, on erection of the tent, extends in an arch from one point adjacent the lower edge of the tent to an opposite point adjacent the lower edge. Each sleeve is closed at one end thereof and open at its other end for the insertion therein of a flexible, resilient rod for holding the tent erect with the rod curved into an arch and holding the sleeve in an arch. The tent has at the open end of each sleeve a strap extending out from the open end of the sleeve, the strap being formed at its outer end with a rod-end-receiving pocket. The pocket is spaced from the open end of the sleeve for the insertion of the rod into the sleeve through the open end of the sleeve and for bending of the rod and insertion of its end extending out of the open end of the sleeve means into the pocket to hold the rod bent into an arch. The pocket is at one face of the strap. A flexible tongue is secured to the strap inwardly of the pocket extending lengthwise of the strap on the one face thereof and is of such length as to be capable of being folded back on itself to form a loop insertable in the pocket with an elongate loose end portion extending out of the pocket. The strap has a hand-grasp extension from the pocket. The tongue is foldable around the end of the rod, and the latter with the tongue folded therearound is insertable in the pocket as facilitated by pulling on the strap via the hand-grasp extension. Removal of the end of the rod from the pocket is facilitated by pulling on the strap via the hand-grasp extension and on the end of the tongue.

15 Claims, 5 Drawing Sheets

TENT

BACKGROUND OF THE INVENTION

This invention relates generally to tents, and more particularly to a tent which is easy to erect and take down.

Heretofore, campers have had difficulty in erecting tents after dark because it is difficult to see and manipulate the tent to erect it. One particular problem at night (and even during daylight) has been assembling the framework or supporting structure (e.g., rods or poles) of the tent. Typically, the tent must be stretched so that the rods or poles can be inserted in loops or pockets on the tent. Stretching the tent and inserting the poles may be difficult with new tents, but the difficulty increases substantially as tents are used and/or abused. Individuals sometimes find the task to be impossible without help. In addition, an individual must usually move around the tent to assemble it since the framework must be manipulated at various point around the tent. And, because the assembly steps may be interrelated, it may be impractical for an individual to erect the tent alone.

SUMMARY OF THE INVENTION

Among the several objects of the invention may be noted the provision of a tent which is easy to erect and take down, even in the dark; the provision of such a tent which can quickly be erected or taken down by an individual staying on one side of the tent; the provision of such a tent which may be of a dome or of an arch or "hoop" configuration; the provision of such a tent which is generally lightweight and durable; the provision of such a tent which is suitable for transport when backpacking; and the provision of such a tent which is economical to manufacture.

Generally, a tent of the present invention has a plurality of sleeve means each of which, on erection of the tent, extends in an arch from one point adjacent the lower edge of the tent to an opposite point adjacent the lower edge. Each sleeve means is closed at one end thereof and open at its other end for the insertion therein of a flexible, resilient rod for holding the tent erect with the rod curved into an arch and holding the sleeve means in an arch. The tent has at the open end of each sleeve a strap extending out from the open end of the sleeve, the strap being formed at its outer end with a rod-end-receiving pocket. The pocket is spaced from the open end of the sleeve means for the insertion of the rod into the sleeve means through the open end of the sleeve means and for bending of the rod and insertion of its end extending out of the open end of the sleeve means into the pocket to hold the rod bent into an arch. The pocket is at one face of the strap. A flexible tongue is secured to the strap inwardly of the pocket extending lengthwise of the strap on the one face thereof, and is of such length as to be capable of being folded back on itself to form a loop insertable in the pocket with an elongate loose end portion extending out of the pocket. The strap has a hand-grasp extension from the pocket. The tongue is foldable around the the end of the rod, and the latter with the tongue folded therearound is insertable in the pocket as facilitated by pulling on the strap via the hand-grasp extension. Removal of the end of the rod from the pocket is facilitated by pulling on the strap via the hand-grasp extension and on the end of the tongue.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
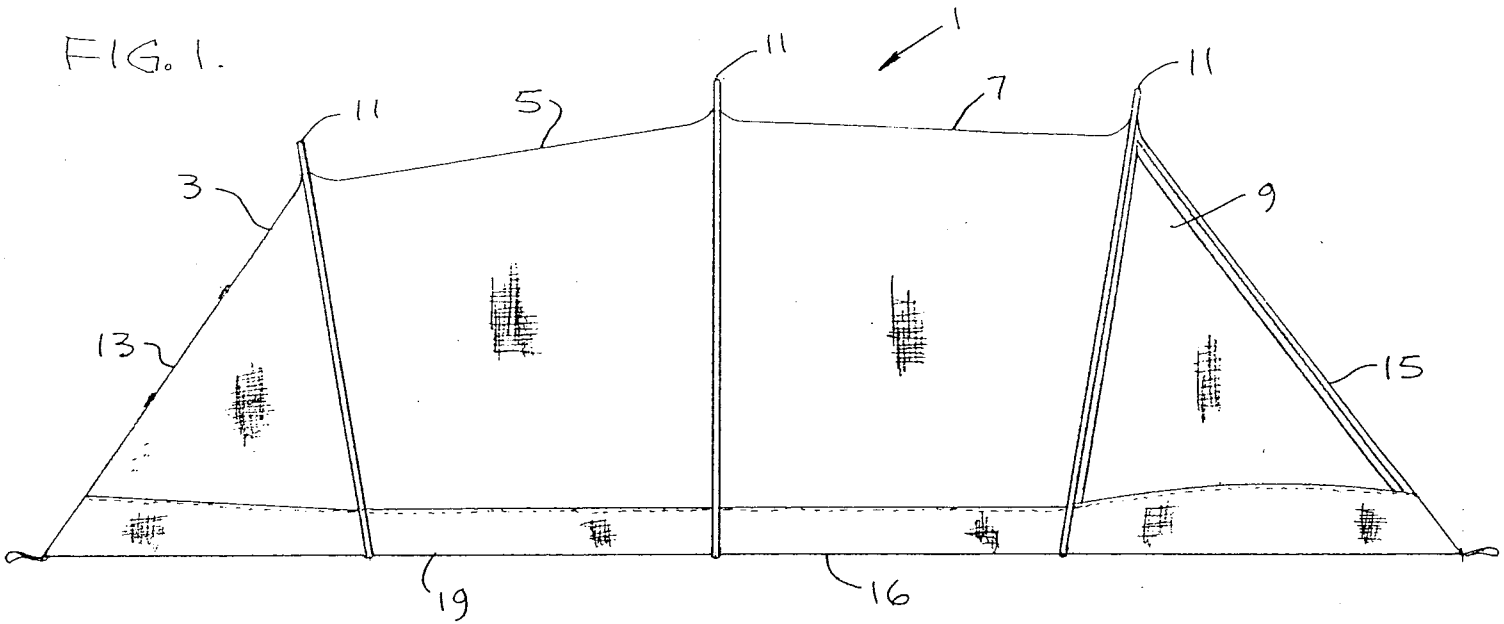
FIG. 1 is a side elevation of a tent of the present invention.
Figure 2:
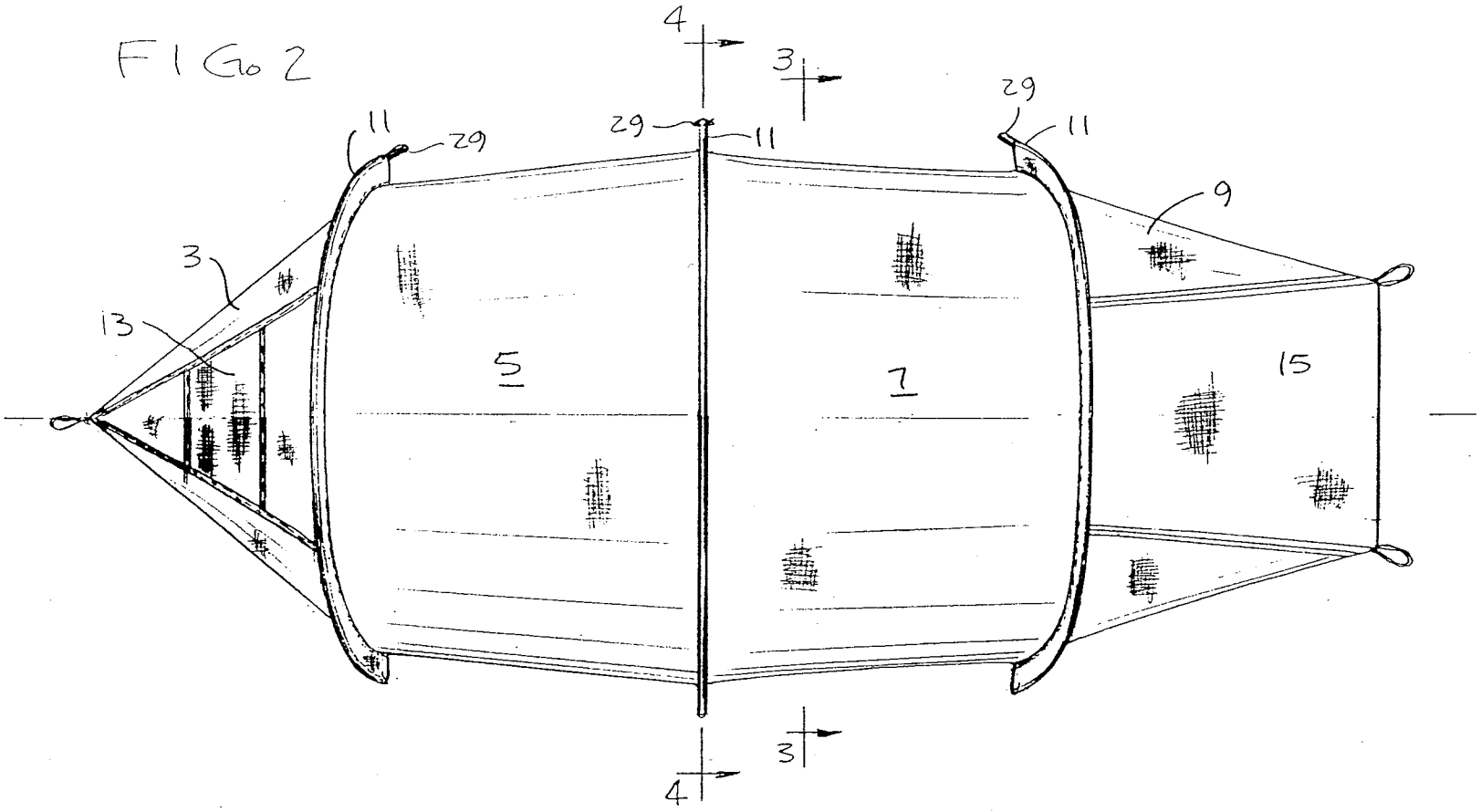
FIG. 2 is a top plan view of the tent of FIG. 1.

Referring now to the drawings, a tent of the present invention is designated in its entirety by reference numeral 1. Tent 1 is generally elongate, and is of the arch or "hoop" type having a generally horizontal longitudinal axis when erected. The tent 1 generally comprises four sections 3, 5, 7, and 9 divided by three sleeves 11 (each constituting "sleeve means") extending laterally of the tent. An insect-resistant mesh window 13 may be provided in end section 3, and a door flap 15 provided in the opposite end section 9. The walls and ceiling of the tent 1 are preferably constructed of suitable breathable fabric, such as lightweight "ripstop" nylon, for proper ventilation, it being contemplated that a water-repellent fly (not shown) would be provided with the tent for protection from rain and snow. The floor 16 of the tent 1 may be also be formed of water-repellent fabric, such as urethane-coated nylon.

Figure 3:
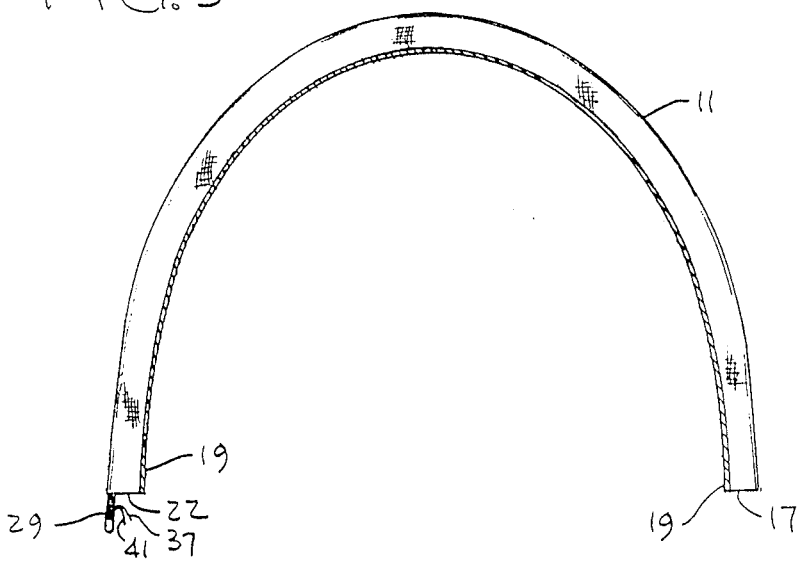
FIG. 3 is a cross-sectional view taken along line 3—3 of FIG. 2.
Figure 4:
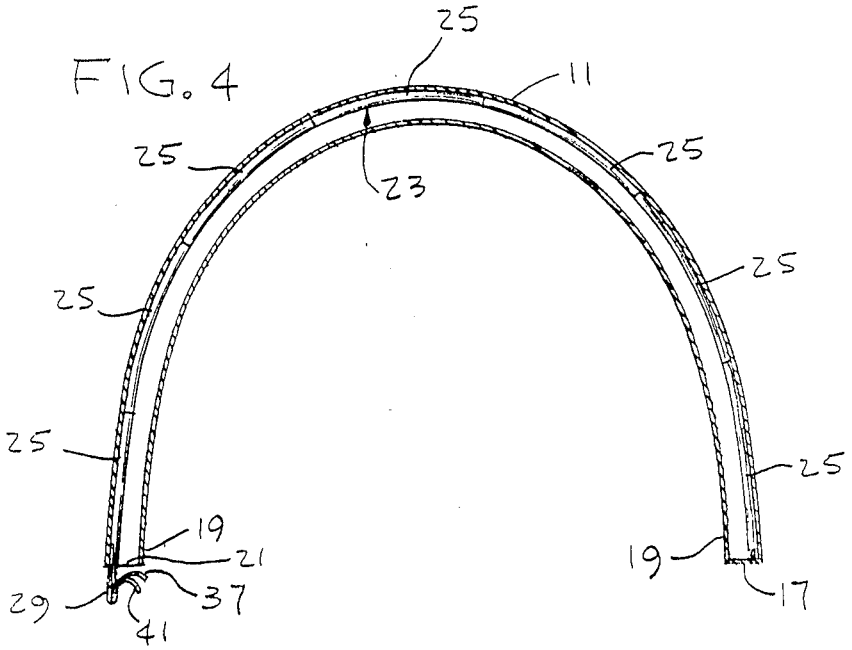
FIG. 4 is a cross-sectional view taken along line 4—4 of FIG. 2.

As shown in FIG. 3, on erection of the tent 1, each of the sleeves 11 extends in an arch from one point 17 adjacent the lower edge 19 of the tent to an opposite point 21 adjacent the lower edge. The sleeves 11 are generally continuous from end or point 17 to the opposite end or point 21. Each sleeve is closed at end 17 thereof and open at its other end 21 for the insertion therein of a flexible, resilient rod 23 (FIG. 4). When inserted into the sleeves 11, each rod 23 is curved into an arch to hold the sleeve 11 in an arch and, thereby, hold the tent 1 erect. The open ends 21 of the sleeves 11 are preferably positioned along the same side of the tent 1 so that the rods 23 may be inserted into the sleeves from the same side of the tent.

Figure 5:
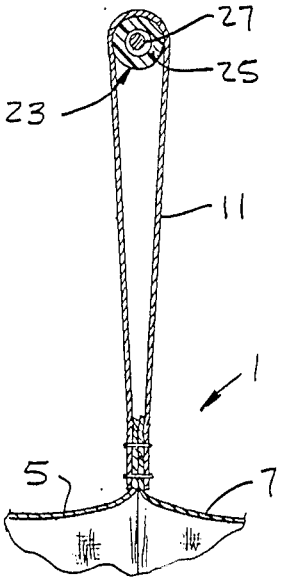
FIG. 5 is a cross-sectional view taken along line 5—5 of FIG. 2.

Preferably, each rod 23 is a telescoping rod comprising a plurality of resilient rod sections 25, each of which has a reduced diameter end portion for insertion in a longitudinal bore of an adjacent rod section to form rod 23. An elastic band 27 (FIG. 5) extends through the longitudinal bores of the rod sections, and is stretched by the rod sections 25 when they are assemblied into rod 23 to hold the sections together. The rod sections 25 may be pulled apart and folded over on each other to form a compact bundle that is easy to pack.

Figure 6:
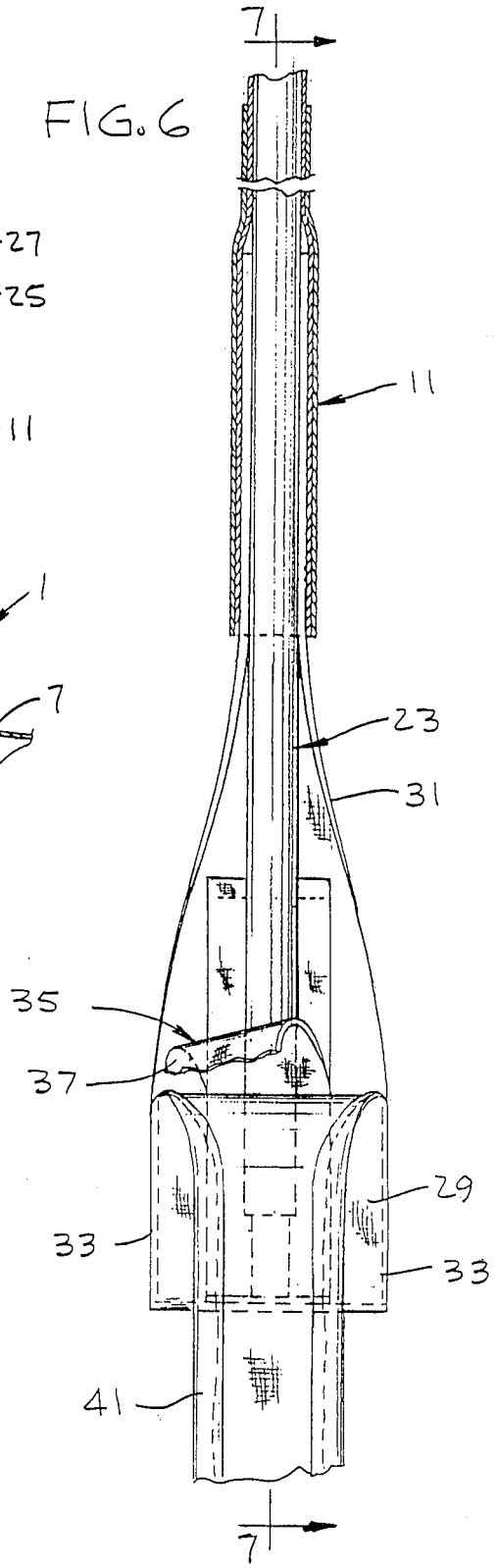
FIG. 6 is a front view of a rod-end-receiving pocket of the tent of FIGS. 1–5.

A pocket 29 (FIGS. 6 and 7) is provided generally adjacent the open end 21 of each sleeve 11 for receiving an end of rod 23. The rod-end-receiving pocket is formed at the outer end of a strap 31 (e.g., of synthetic webbing material) extending out from the open end 21 of each sleeve 11. The pocket 29 is at one face of the strap 31 so that an end of the rod 23 may slide along the strap into the pocket. The pocket 29 may be formed by folding back a portion of the strap 31 onto an adjacent portion of the strap and stitching the portions together along their sides 33. The pocket 29 is sufficiently spaced from the open end 21 of the sleeve 11 so that, after the rod 23 is inserted into the sleeve through the open end of the sleeve, the rod may be bent into an arch and the free end of the rod may be inserted into the pocket to hold the rod in its arched configuration. It will be observed that the rod 23 automatically engages the closed end 17 of the sleeve without any extra effort on the part of the person assembling the tent.

In addition, a flexible tongue 35 (e.g., of synthetic webbing material) is secured to the strap 31 inwardly of the pocket 29. The tongue 35 extends lengthwise of the strap 31 on the same face of the strap as the pocket is formed on. The tongue 35 is of such length as to be capable of being folded back on itself to form a loop (FIGS. 6–7) insertable in the pocket 29 with an elongate loose end portion 37 extending out of the pocket. Each strap 31 and its associated tongue 35 is secured to a respective sleeve 11 by, for example, sandwiching the strap between the tongue and the inside surface of the sleeve adjacent the open end 21 of the sleeve, and then stitching one end of the strap and tongue to the sleeve. A loop 39 for holding a stake (not shown) may also be stitched to each strap 31.

Each strap 31 has a hand-grasp extension 41 comprising an outer end portion of the strap extending outwardly from the pocket 29. The hand-grasp extension 41 and tongue 35 facilitate inserting an end of the rod 23 into the pocket 29. More specifically, the tongue 35 is foldable around the the end of the rod 23 and, by pulling on the strap in the direction away from the sleeve 11 via the hand-grasp extension 41 and pulling on the free end 37 of the tongue in the direction generally toward the sleeve, the rod is insertable in the pocket. The free end of the rod 23 slides along the tongue 35 as the end or the tongue is pulled inwardly with respect to the tent 1, thereby causing the arch or curvature of the rod to increase so that it can fit in the pocket 29. Removal of the end of the rod 23 from the pocket 29 is facilitated in similar manner, that is, by pulling on the strap 31 via the hand-grasp extension 37 and on the end of the tongue 35.

Figures 7, 8:
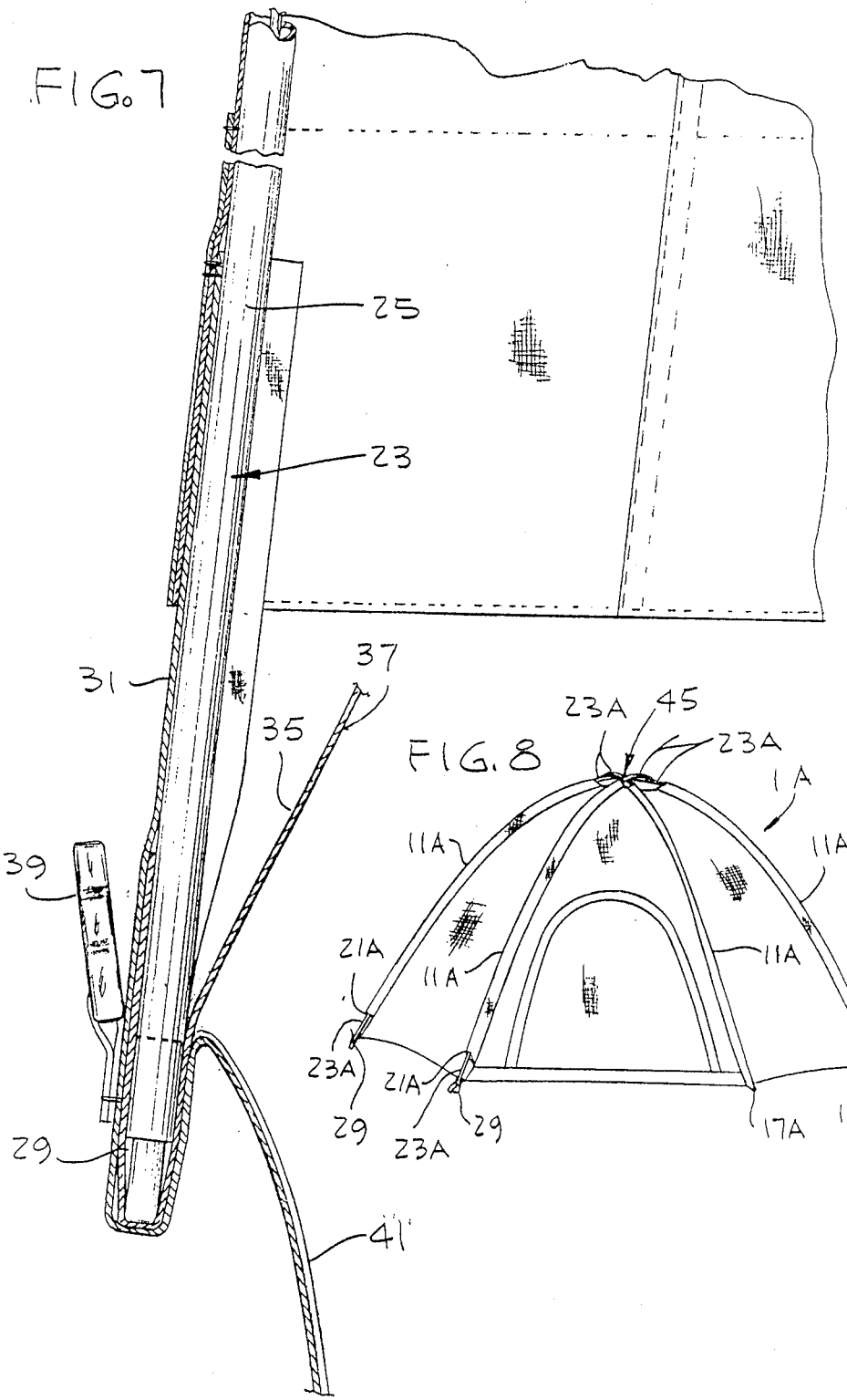
FIG. 7 is a cross-sectional view taken along line 7—7 of FIG. 6.
FIG. 8 is a view similar to FIG. 1 showing another embodiment of a tent of the present invention.

FIG. 8 illustrates another embodiment of the invention generally corresponding to the embodiment of FIGS. 1–7, the principal difference being that the tent, herein designated 1A, is of generally dome shape when erected having a plurality of sleeve means extending radially of the dome along the upper surface 43 of the dome. Each sleeve means comprises one or more sleeves 11A which are discontinuous at the top 45 of the dome so that the rods 23A can cross over one another. The open ends 21A of the sleeve means are positioned along one side of the tent 1A and the closed ends 17A of the sleeve means are positioned along the other side of the tent so that the rods 23A may be inserted into the sleeves 11A from the same side of the tent.

It will be observed that one person, working from only one side, can assemble and disassemble the tent.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent having a plurality of sleeve means each of which, on erection of the tent, extends in an arch from one point adjacent the lower edge of the tent to an opposite point adjacent the lower edge, each sleeve means being closed at one end thereof and open at its other end for the insertion therein of a flexible, resilient rod for holding the tent erect with the rod curved into an arch and holding the sleeve means in an arch, said tent having at the open end of each sleeve a strap extending out from said open end of the sleeve, said strap being formed at its outer end with a rod-end-receiving pocket, the pocket being spaced from said open end of the sleeve means for the insertion of the rod into the sleeve means through the open end of the sleeve means and for bending of the rod and insertion of its end extending out of the open end of the sleeve means into the pocket to hold the rod bent into an arch, the pocket being at one face of the strap, a flexible tongue secured to said strap inwardly of said pocket extending lengthwise of said strap on said one face thereof and of such length as to be capable of being folded back on itself to form a loop insertable in the pocket with an elongate loose end portion extending out of the pocket, said strap having a hand-grasp extension from said pocket, the tongue being foldable around the said end of the rod and the latter with the tongue folded therearound being insertable in the pocket as facilitated by pulling on the strap via said hand-grasp extension, removal of the end of the rod from the pocket being facilitated by pulling on the strap via said hand-grasp extension and on the end of the tongue.

2. A tent as set forth in claim 1 wherein the tent is generally elongate having a longitudinal axis adapted to be generally horizontal, said sleeve means extending laterally of the tent, and the open end of each sleeve means being positioned along one side of the tent whereby the rods may be inserted into the plurality of sleeve means from the same side of the tent.

3. A tent as set forth in claim 2 wherein each sleeve means comprises a generally continuous sleeve, the sleeve being substantially continuous from said one point to said opposite point.

4. A tent as set forth in claim 3 wherein the pocket is formed by folding back a portion of said strap onto an adjacent portion of the strap and stitching said portions together along their sides.

5. A tent as set forth in claim 4 wherein said hand-grasp extension comprises an outer end portion of said strap extending outwardly from the pocket.

6. A tent as set forth in claim 5 wherein the strap and tongue comprise sections of synthetic webbing material.

7. A tent as set forth in claim 1 wherein the tent is of generally dome shape when erected, each sleeve means extending radially of the tent along the upper surface of the tent.

8. A tent as set forth in claim 7 wherein each sleeve means comprises one or more sleeves, the sleeves being discontinuous at the top of the dome.

9. A tent as set forth in claim 8 wherein the open ends of the plurality of sleeve means are positioned along one side of the tent and the closed ends of the plurality of sleeve means are positioned along the other side of the tent whereby the rods may be inserted into the plurality of sleeve means from the same side of the tent.

10. A tent as set forth in claim 9 wherein the pocket is formed by folding back a portion of said strap onto an adjacent portion of the strap and stitching said portions together along their sides.

11. A tent as set forth in claim 10 wherein said hand-grasp extension comprises an outer end portion of said strap extending outwardly from the pocket.

12. A tent as set forth in claim 11 wherein the strap and tongue comprise sections of synthetic webbing material.

13. A tent as set forth in claim 1 wherein the pocket is formed by folding back a portion of said strap onto an adjacent portion of the strap and stitching said portions together along their sides.

14. A tent as set forth in claim 13 wherein said hand-grasp extension comprises an outer end portion of said strap extending outwardly from the pocket.

15. A tent as set forth in claim 1 wherein the open ends of the plurality of sleeve means are positioned along one side of the tent and the closed ends of the plurality of sleeve means are positioned along the other side of the tent whereby the rods may be inserted into the plurality of sleeve means from the same side of the tent.

* * * * *